US006257737B1

(12) United States Patent
Marshall et al.

(10) Patent No.: US 6,257,737 B1
(45) Date of Patent: Jul. 10, 2001

(54) LOW-PROFILE LUMINAIRE HAVING A REFLECTOR FOR MIXING LIGHT FROM A MULTI-COLOR LINEAR ARRAY OF LEDS

(76) Inventors: Thomas M. Marshall, 48 Charlotte Pl., Hartsdale, NY (US) 10530; Michael D. Pashley, 9 Andre La., Cortlandt Manor, NY (US) 10567; Stephen Herman, 20 Sylvan Rd., Monsey, NY (US) 10952

( * ) Notice: Subject to any disclaimer, the term of this patent is extended or adjusted under 35 U.S.C. 154(b) by 0 days.

(21) Appl. No.: 09/315,706

(22) Filed: May 20, 1999

(51) Int. Cl.[7] ..... F21V 9/00
(52) U.S. Cl. ..... 362/231; 362/235
(58) Field of Search ..... 362/231, 235, 362/247, 555, 545, 800, 297, 346

(56) References Cited

U.S. PATENT DOCUMENTS 5,222,795 * 6/1993 Hed ..... 362/31 X
5,642,933 7/1997 Hitora ..... 362/243
5,921,652 * 7/1999 Parker et al. ..... 362/231 X

FOREIGN PATENT DOCUMENTS

4237107A1 5/1994 (DE) ..... F21S/5/00

OTHER PUBLICATIONS

JP 6–237017, "Polychromatic Light Emitting Diode Lamp", Abstract.

* cited by examiner

*Primary Examiner*—Stephen Husar

(57) ABSTRACT

A linear array of LED light sources in a plurality of colors is situated along the length of a reflector which is positioned so that it receives substantially all the light within the semi-cone angles of the sources, and is shaped so that it is illuminated substantially uniformly along its width. The reflector may be configured as a smooth Lambertian surface, or may be configured as a curve approximated by a series of flat specular reflecting segments.

18 Claims, 3 Drawing Sheets

| $i$ | $\theta_i$ | $x_i$ | $z_i$ | $r_i$ |
|---|---|---|---|---|
| 1 | $2\theta_s$ | $\alpha W$ | $z_0 + \alpha W \tan(2\theta_s)$ | $\alpha W / \cos(2\theta_s)$ |
| $i$ | $2\theta_s\{1-[(i-1)/2n]\}$ | $r_i \cos(\theta_i)$ | $z_0 (2n+1-i)/2n + r_i \sin(\theta_i)$ | $r_{i-1} + \phi_{i-1}(W - r_1)$ |
| $(2n+1)$ | 0 | $W$ | 0 | $W$ |

LOW-PROFILE LUMINAIRE HAVING A REFLECTOR FOR MIXING LIGHT FROM A MULTI-COLOR LINEAR ARRAY OF LEDS

BACKGROUND OF THE INVENTION

The invention relates to a luminaire having a reflector which mixes light from a multi-color array of LEDs, and more particularly to a low-profile luminaire which generates white light from a linear array of LEDs.

A standard low profile luminaire for mounting in a ceiling employs tubular discharge lamps having fluorescent coatings which determine the spectra of emitted light. The lamps generally are not dimmable, and the user has no control over the color temperature.

An array of LEDs in each of a plurality of colors offers the possibility of creating a luminaire in which the color temperature may be controlled at any power level, thereby enabling a lamp which is dimmable and emits a uniformly white light at any power level.

The English abstract of JP-A-06 237 017 discloses a polychromatic light emitting diode lamp having a 3×3 array of light emitting diodes of two types, a first type having elements for emitting red light and blue light, and a second type having elements for emitting red light and green light. The stated object is to mix colors so that the mixed color would be recognized as the same color in any direction, but there are no optical provisions to facilitate mixing. It is simply a two-dimensional array of LEDs in a lamp case filled with resin, which would do little more than provide some diffusion.

U.S. application Ser. No. 09/277,645, which was filed on Mar. 26, 1999, discloses a luminaire having a reflector which mixes light from a multi-color array LEDs. The array is arranged in the entrance aperture of a reflecting tube which preferably flares outward toward the exit aperture, like a horn, and has a square or other non-round cross section. The object is to produce a collimated beam of white light in the manner of a spotlight. However the design is unsuitable for a low-profile luminaire for general diffuse illumination.

SUMMARY OF THE INVENTION

It is an object of the invention to provide a low-profile luminaire which produces white light from a multi-color array of LEDs, plus the ability to control and vary color temperature, at full power and dimmed.

The luminaire according to the invention utilizes a linear array of light injectors, including at least one light injector in each of a plurality of colors, typically red, green, and blue. Each injector has an LED in the respective color, and design optics for confining the emitted light within a cone having semi-angle $\theta_s$. The array is parallel to the y-axis of an x-y-z coordinate system, arranged so that substantially all of the emitted light is emitted in the positive x and z directions.

A reflector situated beside the array of light injectors has a shape defined by a curve in the x-z plane in the positive x and z directions. The surface is formed by a projection of the curve parallel to the y-axis, and is arranged to receive substantially all of the light within the semi-angles $\theta_s$ of the injectors in the array.

A luminaire according to the invention offers the advantage of adjustable color temperature, because the power to the LEDs in each color of the array may be controlled individually. Likewise, the luminaire is fully dimmable, as the power to the different color LEDs may be controlled in concert.

The preferred luminaire also has two plane mirrors parallel to the x-z plane at the ends of the surface. Their purpose is to contain and redirect light from the injectors and the main reflector either to the main reflector or to the exit aperture.

The reflector preferably has a Lambertian surface, which is a diffusing surface for which the intensity of reflected radiation is substantially independent of direction (a perfectly diffusing surface is a Lambert surface). A phosphor powder coating can yield 95–99% reflection, while a brushed aluminum surface can yield 75% reflection. The surface may have partially specular reflectivity, so that it has partially directional reflected light. Such a luminaire could serve as a wall sconce where a portion of the light is directed at the floor for walking illumination while the rest of the light gives general diffuse illumination.

The luminaire preferably also includes a cover plate which provides mechanical protection for the main reflector, and defines the exit aperture. This plate may be transparent, or may provide any desired amount of diffusion. It may be designed as a lens which cooperates with a reflector having a non-uniform intensity.

Note that the rectangular coordinate system used herein to define the geometry of the luminaire is arbitrarily assigned, as it could be to any other system. However, it is conventional in the United States, for optical apparatus, to show light transmitted in the negative z-direction, from positive to negative.

DETAILED DESCRIPTION OF THE PREFERRED EMBODIMENTS

Figure 1:
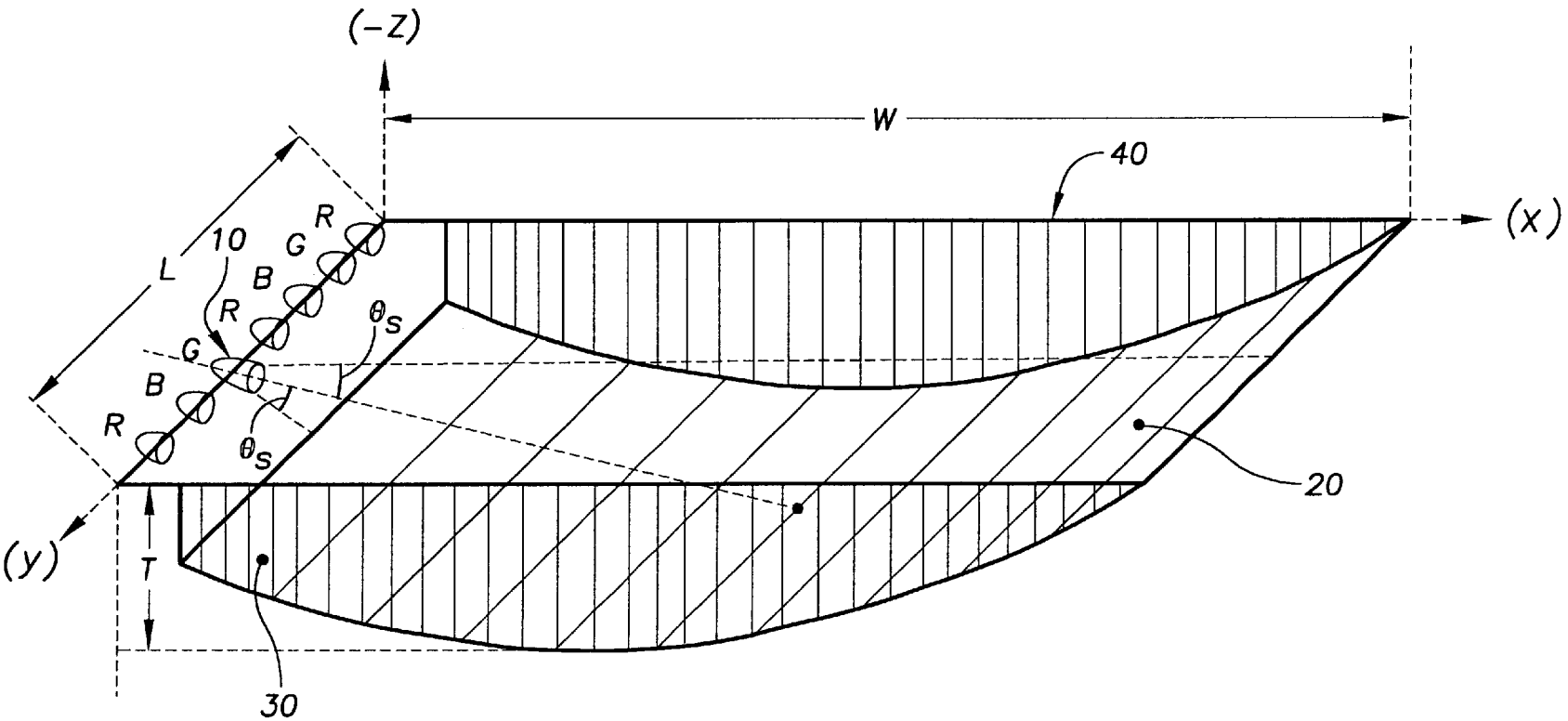
FIG. 1 is a schematic perspective of a low-profile luminaire according to the invention.

Referring to FIG. 1, the luminaire according to the invention comprises a linear array of LED sources or injectors 10, a specially curved Lambertian reflector 20, two specular reflecting planar sidewalls 30, and a transparent cover plate 40. The design parameters of the LED sources 10 and of the reflector 20 are interrelated. There is no single optimum design, but rather a set of trade offs among such parameters as thickness, total lumen output, and degree of color mixing at the coverplate (all designs mix well at a distance). In order to get good color mixing at the cover plate, the different color LEDs should be distributed as uniformly as possible.

The luminaire has a width W, a length L, and a thickness T (x, y, and z dimensions respectively; a left-handed coordinate system is shown). The constraints on each of the dimensions are different and depend on the application, but generally the width is 100–400 mm, the thickness is 10–25% of the width, and the length can vary from about 100 mm to several meters (there is no constraint on the length).

Each source 10 is a package of one or more LED chips plus primary optics, comprising an "injector". The injectors are positioned in a roughly linear array along the length of the luminaire (parallel to y-axis, near x=0). Each injector emits into a cone of semi-angle $\theta_s$, which is determined by a reflector such as a compound parabolic concentrator (CPC) or other optics. CPC's are discussed in High Collection Imaging Optics by Welford and Winston (Academic Press, 1989). The semi-angle should be 5–30 degrees, with a typical value of 15 degrees. The cone axis lies in the x-z plane, and is rotated an angle $\theta_s$ from the x-axis towards the z-axis, such that an extreme ray lies in the x-y plane (at z=0), parallel to the x-axis.

As mentioned above, the reflector 20 is a Lambertian reflector which maximizes diffusion. The reflector 20 is shaped such that the injectors illuminate the reflector either uniformly along the x direction or, more generally, according to a specified (non-uniform) pattern. The choice of pattern depends upon the application (see below for an example using a non-uniform distribution). The reflector shape is defined by a curve in the x-z plane, which accomplishes this illumination pattern. The surface is then defined by a parallel projection of this curve in the y-direction. It is important to note that a surface generated in this way is relatively easy to manufacture. The starting material (e.g. glass or aluminum) can be planar, and then formed into the appropriate shape without any "wrinkles". There are many suitable ways to specify the shape of the curve in the x-z plane.

Figures 2A, 2B:
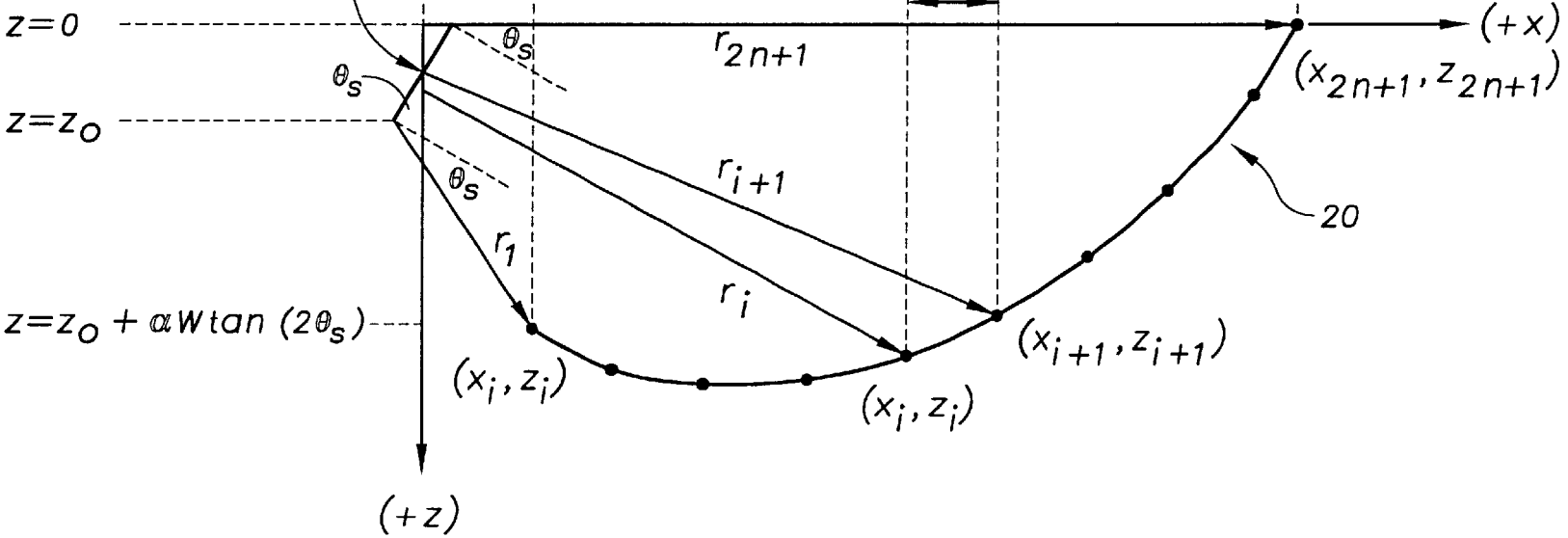
FIG. 2A is a schematic end view of the luminaire, showing the geometry.
FIG. 2B is a table defining the parameters in FIG. 2A.

FIG. 2 shows one method, where the injector emission cone full angle $2\theta_s$ is divided into (2n) intervals bounded by (2n+1) rays. The first ray ($r_1$) is chosen as an extreme ray of the injector, making an angle of $2\theta_s$ with the x-axis. The starting point ($x_1$, $y_1$) for the surface is chosen at $x_1=\alpha W$, an arbitrary distance away from the center of the injector (at x=0) and $z_1 = Z_0 + \alpha W \tan(2\theta_s)$, such that an extreme ray from the injector just intersects this point. $\alpha$ is typically about 0.05, but may vary as a design parameter. $z_0$ is the z-axis projection of the exit aperture of the injector. The next point ($x_2$, $y_2$) is chosen such that it lies on the next ray ($r_2$), a distance in the x direction proportional to the reciprocal of the fractional flux $\phi_1$ desired for that x-coordinate. Note that for the uniform-distribution case, $\phi_i=1/(2n)$ for all i. In all cases, the flux-weighting coefficients $\phi_1$ are normalized such that $\Sigma\, \phi_i=1$. Subsequent points are defined by repeating this procedure (see the inductive formula in FIG. 2), and then connecting the set of points and smoothing the curve appropriately. The details of the smoothing are not important to the proper functioning. It is also possible to design the curve empirically, either experimentally or using a ray-tracing program. A reflector of the general shape of FIG. 2 can be varied in a trial-and-error fashion until the distribution at the cover plate (or at some intermediate distance away from the cover plate) has the desired distribution, uniform or otherwise.

The main reflector 20 is bounded by two plane mirrors 30 (parallel to the x-z plane, at y=0 and y=L). These mirrors 30 are bounded in the z-direction by the x-y plane (at z=0) and by the main reflector surface. Their purpose is to contain and redirect light (from the LED sources, from the main reflector, and also reflected from the cover plate) either to the main reflector or to the exit aperture.

The transparent cover plate 40 provides mechanical protection to the main reflector 20, and defines the exit aperture. It may be plastic or glass. It is permissible that this plate be a flat, smooth plate (i.e. clear transparent), or that it have any desired amount of diffusion (e.g. ground glass, prismatic glass, corrugated glass, etc.). The specific properties of the cover plate will affect the appearance of the luminaire, and to a certain extent the overall light output distribution. The cover plate is not essential to the principle of operation, but rather allows design variation.

Among the most fundamental variable parameters are emission patterns and directions of the injectors. The injectors determine such properties as the luminaire width and thickness, the amount of near-field color mixing (i.e. what is seen at the exit aperture), and the total lumen output for a given exit aperture area.

As an example of how the injector influences the luminaire size and also the total lumen output for a given luminaire size, consider the parameter $\theta_s$, the angular emission width of the injector. From the invariance of the etendue, the larger the angle $\theta_s$, the smaller the injector exit aperture can be. A smaller injector allows a higher packing density (and thus more total lumen output for a given luminaire length). But with the necessarily-larger $\theta_s$, the luminaire thickness must increase (as can be seen by considering FIG. 2). On the other hand, a larger $\theta_s$ allows better lateral mixing of colors in the near field as there is a greater overlap of the beams on the reflector.

One possible design variant is that each injector may be positioned with its cone axis rotated by a specific angle $\theta_t$ out of the x-z plane. For example, injectors away from the midpoint of the source array may be rotated to point slightly towards the center (a "toe-in" angle).

Additionally, each injector may emit into an elliptical cone, wider in the x-y plane, with a semi-angle up to 45 degrees, and narrower in the x-z plane. This better optimizes mixing and size, at the cost of some increased design complexity.

Another variation is to put in two or more rows of injectors. This has the benefit of increasing the amount of light available, and also of improving mixing (since more than one LED can illuminate the same region of the reflector), while somewhat complicating the design of the main reflector and increasing the thickness.

In yet another variation, the main reflector can be made to have a partly specular/partly Lambertian reflectivity (by any of several techniques). Such a luminaire would have a partly directional beam. An example application is a wall sconce where a portion of the beam is directed at the floor for walking illumination, while the rest of the light gives general diffuse illumination.

Figure 3:
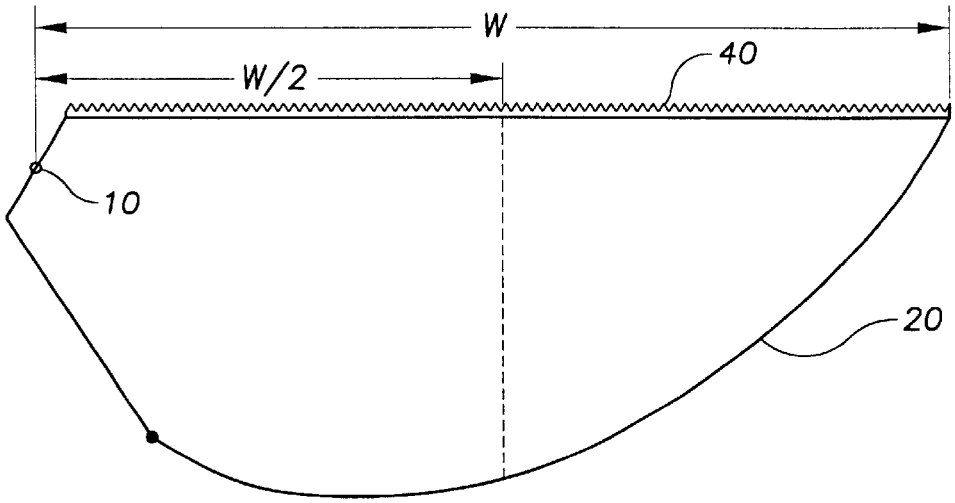
FIG. 3 is a schematic end view showing a luminaire with a cover plate configured as a Fresnel lens.

FIG. 3 shows an example of an application using a non-uniform intensity distribution across the exit aperture. The main reflector can be designed to have a strong intensity peak in the center (i.e. more light is concentrated near the line in the x-y plane x=W/2). The transparent cover plate 40 is a cylindrical Fresnel lens, and the output distribution in the x-z plane will be concentrated about the -z direction. The distribution in the y-z plane will remain Lambertian.

Figure 4:
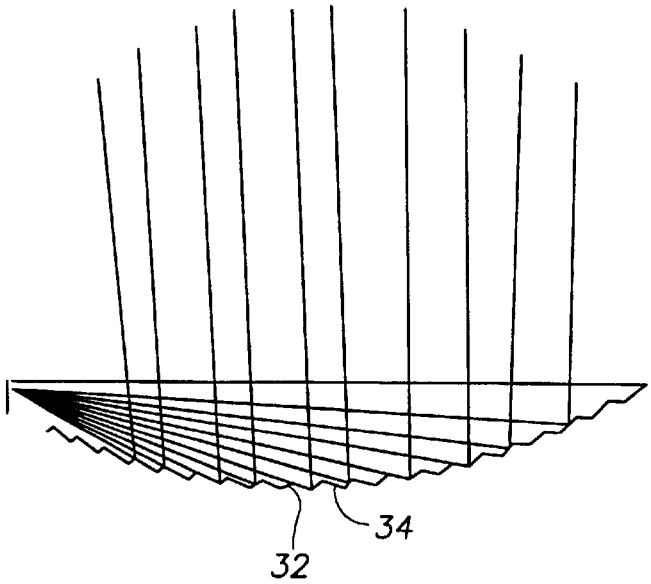
FIG. 4 shows a design variation utilizing a main reflector designed as a series of specular reflecting slats parallel to the y-axis.

FIG. 4 shows a variation wherein the curved main reflector 30 is approximated by a series of flat specular reflecting segments 32, which are connected by intermediate segments 34, which do not receive light. The segments 32 may be oriented so that any desired direction of reflected light may be achieved, shown here as all being parallel to the z-axis. Since metal reflectors with strongly anisotropic scattering properties exist, there is considerable design freedom for a reflector of this type.

The foregoing is exemplary and not intended to limit the scope of the claims which follow.

What is claimed is:

1. A luminaire comprising a linear array of light injectors comprising at east one injector for emitting light in each of a plurality of colors, each injector emitting rays of light in a cone having a semi-angle $\theta_s$, said array being parallel to the y-axis of an x-y-z coordinate system, and arranged so that substantially all of said light is emitted in the positive x and z directions, and a reflector having a surface with a shape defined by a curve in the x-z plane in the positive x and z directions, said surface being formed by a projection of said curve parallel to the y-axis, said surface being arranged to receive substantially all of said light within the semi-angles $\theta_s$ of the injectors in the array.

2. A luminaire as in claim 1 wherein said reflector is a Lambertian reflector.

3. A luminaire as in claim 2 wherein said surface of said reflector is coated with a phosphor.

4. A reflector as in claim 3 wherein said surface is brushed aluminum.

5. A luminaire as in claim 1 further comprising a pair of planar reflecting sidewalls parallel to the x-z plane and bounding the surface of the reflector.

6. A luminaire as in claim 5 wherein said sidewalls are specular reflecting.

7. A luminaire as in claim 1 wherein the reflector is shaped so that the injectors illuminate it uniformly in the x-direction.

8. A luminaire as in claim 1 wherein said rays of light include a pair of extreme rays which bound the light emitted from said array in the x-z plane, one of said extreme rays being parallel to the x-axis at z=0, the other of said extreme rays being emitted at $z=z_o$ at an angle of $2\theta_s$) to the x-axis.

9. A luminaire as in claim 8 wherein the said curve is bounded by a first terminal point at (x,z)=(W,0), and a second terminal point at $(x,z)=z_o+\alpha W \tan(2\theta_s)$, wherein $\alpha$ is a design parameter.

10. A luminaire as in claim 1 wherein each injector comprises an LED emitting light in the respective color, and design optics for confining the emitted light within the cone having semi-angle $\theta_s$.

11. A luminaire as in claim 1 wherein said linear array comprises at least two rows of light injectors.

12. A luminaire as in claim 1 wherein at least some of said injectors emit light in elliptical cones.

13. A luminaire as in claim 12 wherein said elliptical cones are wider in the x-y plane than in the x-z plane.

14. A luminaire as in claim 1 wherein at least some of said cones have axes which form an acute angle with the x-z plane.

15. A luminaire as in claim 14 wherein said array has a midpoint, injectors which are remote from said midpoint having axes which are rotated toward said midpoint.

16. A luminaire as in claim 1 wherein said curve is approximated by a series of flat segments arranged parallel to the y-axis, and at an orientation which varies with the x-coordinate for each slat.

17. A luminaire as in claim 16 wherein each segment is a specular reflector.

18. A luminaire as in claim 17 wherein said slats are positioned and arranged to reflect light substantially parallel to the z-axis.

* * * * *

UNITED STATES PATENT AND TRADEMARK OFFICE

CERTIFICATE OF CORRECTION

PATENT NO. : 6,257,737 B1 
DATED : July 10, 2001
INVENTOR(S) : Thomas M. Marshall, Michael D. Pashley and Stephen Herman It is certified that error appears in the above-identified patent and that said Letters Patent is hereby corrected as shown below:

Title page,
Item [73], please add as follows:
-- [73] Assignee: Philips Electronics North America Corp., New York, NY (US) --.

Signed and Sealed this

Ninth Day of July, 2002

*Attest:*

*Attesting Officer*

JAMES E. ROGAN
*Director of the United States Patent and Trademark Office*